US005676180A

United States Patent [19]

Teel

[11] Patent Number: 5,676,180

[45] Date of Patent: Oct. 14, 1997

[54] METHOD AND SYSTEM FOR STORING AND HYDRAULICALLY-PRESSURIZING COMPRESSED NATURAL GAS (CNG) AT AN AUTOMOTIVE RE-FUEL STATION

[76] Inventor: James R. Teel, P.O. Box 208, Bull Shoals, Ark. 72619

[21] Appl. No.: 615,690

[22] Filed: Mar. 13, 1996

[51] Int. Cl.[6] ..... B65B 1/04

[52] U.S. Cl. ..... 141/18; 141/21; 141/25; 222/389; 137/267

[58] Field of Search ..... 141/18, 114, 25, 141/26, 28, 39, 67, 82, 98, 231, 21; 222/386.5, 389, 95, 105, 146.5; 137/267

[56] References Cited

U.S. PATENT DOCUMENTS

| | | | |
|---|---|---|---|
| 4,213,545 | 7/1980 | Thompson et al. | 222/389 |
| 4,750,869 | 6/1988 | Shipman, III | 417/342 |
| 5,002,203 | 3/1991 | Einer | 222/389 |
| 5,603,360 | 2/1997 | Teel | 141/18 |

*Primary Examiner*—Henry J. Recla
*Assistant Examiner*—Steven O. Douglas

[57] ABSTRACT

A system for delivering natural gas, from a moveable transport or pipeline, is off-loaded at an automotive re-fueling station, or other end-user facility, into one or more storage vessels equipped with internal flexible bladders. The pressure of the gas, stored inside the bladders, will be increased to levels sufficient for re-filling automotive on-board storage tanks, or other end uses, by pumping a hydraulic fluid in the annulus between the bladder and the walls of the steel storage vessels, thereby collapsing the flexible bladder and squeezing gas out to an on-board storage tank. The use of a hydraulic pump, instead of a more-expensive compressor, to pressurize the gas, results in significant cost savings which reduces the overall cost of CNG at the station, making CNG (the "preferred alternative fuel") less expensive than gasoline and/or diesel, which will enable CNG to replace gasoline and/or diesel as the primary fuel for automobiles, trucks, and busses.

3 Claims, 2 Drawing Sheets

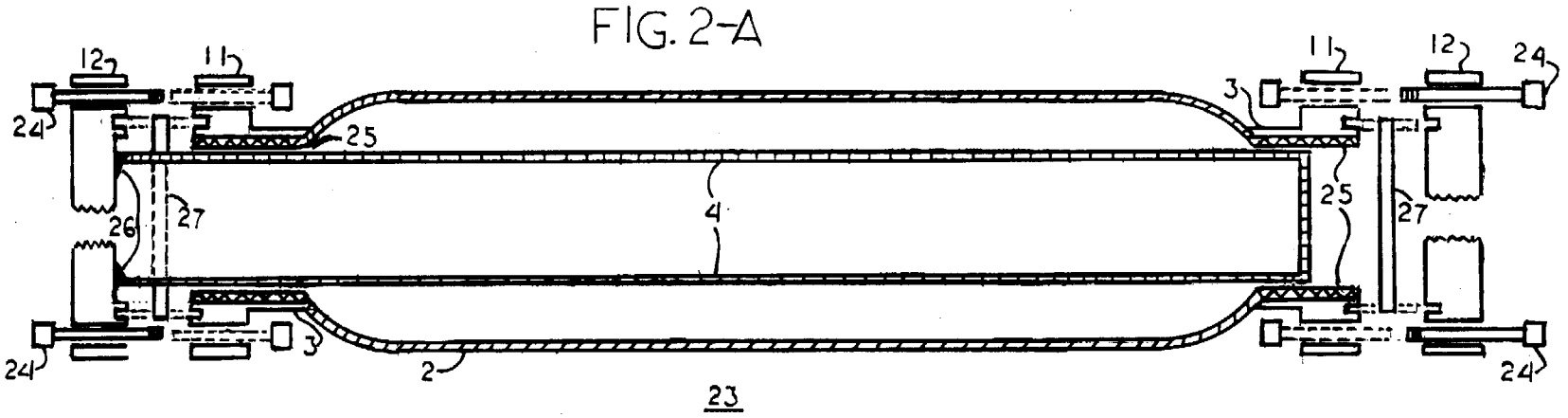
FIG. 2-A
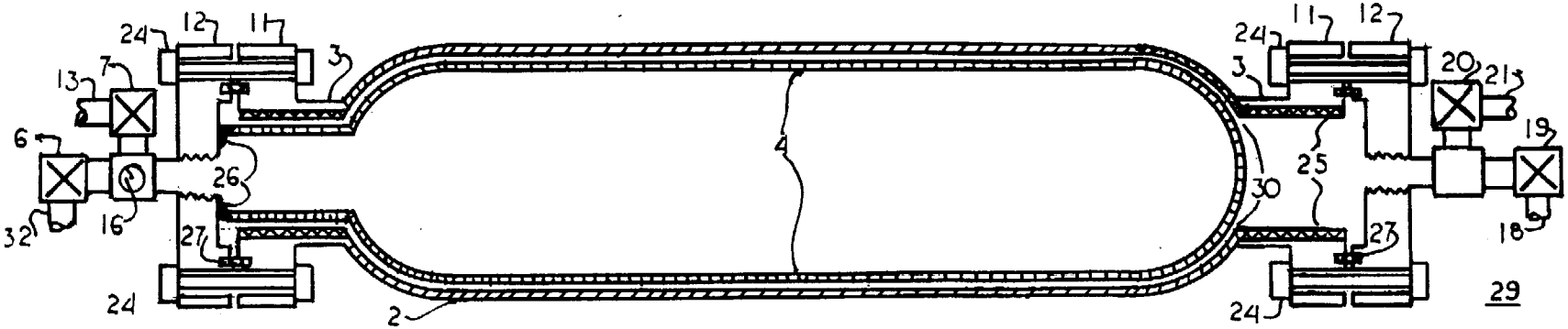
FIG. 2-B

METHOD AND SYSTEM FOR STORING AND HYDRAULICALLY-PRESSURIZING COMPRESSED NATURAL GAS (CNG) AT AN AUTOMOTIVE RE-FUEL STATION

BACKGROUND OF THE INVENTION

1. Field of the invention

The present invention relates generally to a method and a system for storing natural gas at an automotive re-fuel station for the purpose of re-fueling automobiles, busses, and trucks, and storage at other end user facilities. More particularily, it relates to such a method and system especially adapted to the economics involved with equipment used to increase the pressure of the stored natural gas from the pressure at which it was delivered to the re-fuel facility, to the pressure necessary to fill on-board storage tanks in the automobiles, trucks, and busses. The present invention relates, specifically, to the use of a flexible bladder, inside a steel vessel, to receive and store natural gas at a re-fuel site. In order to increase the pressure of the stored gas, a hydraulic fluid is pumped into the annulus between the outer walls of the bladder and the inner walls of the steel tank. With continued pumping, pressure in the annulus will exceed the gas pressure inside the bladder and the bladder collapses in size which results in the gas inside the reduced-size container (the bladder) being elevated to a higher pressure. The higher-pressured gas can then be transferred to a re-fill island on demand to fill on-board storage tanks. Without the presence of an internal flexible bladder, the storage vessel would have to be un-loaded with the assistance of an expensive compressor, which would increase the cost of compressed natural gas at the re-fuel station and make it more difficult for natural gas (the "preferred alternative fuel") to compete with gasoline and/or diesel as the primary fuel for automobiles, busses, and trucks.

2. Description of the prior art

The conventional manner of providing compressed natural gas to automobiles, trucks, and busses, is to bring the gas to the station site, by truck, or pipeline, and transfer the gas to storage vessels (usually one or more municipal code approved ASME vessels specifically designed for storage of hazardous gases). Since the gas will not flow, by gravity, the transfer from the delivery vehicle (or pipeline) into storage vessels must be accomplished by use of one or more multi-stage compressors. Once the gas is in storage, it must be further compressed to increase the pressure up to the level necessary to fill on-board storage tanks in automobiles, trucks, and busses. While the conventional method and system has proven successful in many instances, the economic costs are so expensive as to make the use of natural gas non-competitive with conventional fuels such as gasoline and diesel.

The present invention is intended to solve the need for a more-economical method of storing and pressurizing natural gas so that the delivered cost of compressed natural gas (CNG) is substantially less than conventional gasoline and/or diesel fuels. The desired economics are possible due to the elimination of multi-stage compressors to un-load the gas from delivery vessels, and to pressurize the gas up to levels to re-fill on-board storage tanks. In this invention, the physical work of pressurizing the gas will be accomplished by pumping a hydraulic fluid in the annulus between the bladder and the steel walls of the storage vessel. The hydraulic pump - collapsing bladder work will replace the physical work of a multi-stage compressor, at a substantial cost savings.

The flexible bladder is a one-piece cylinder liner which, when filled with gas will inflate substantially to the interior walls of the steel tubes which are 20 inches in diameter and 22 feet in length, made of rubberized nylon, or by choice, some other member of the elastomer family of synthetic rubbers, compatible with natural gas, fresh water/anti-freeze mix, or mineral hydraulic oil, with one domed end, the end open attached (bonded) to the face of a flange attached to the steel tube.

The hydraulic fluid is a matter of choice and can be either a water/anti-freeze mix or a mineral hydraulic oil.

The present invention is particularily designed for more-economical storage and pressurization of natural gas utilizing a hydraulic pump instead of a gas compressor. While primarily designed to reduce the delivered price of compressed natural gas to re-fuel automobiles, busses, and trucks, the invention can also serve as a more-economical method of storing and pressurizing natural gas for other end-uses, such as for fork-lift trucks, airport luggage and passenger transports, and generally any other method of transportation involving gasoline and/or diesel fuels.

SUMMARY OF THE INVENTION

In the method and system of the invention, a terminal is built at a re-fueling station which consists of un-loading conduits, control mechanisms, and measuring devices for three storage vessels, each with an internal flexible, bladder, together with a hydraulic pump, motor, and surge tank. Start-up operations of the system will commence with the arrival of natural gas, by moveable transport or pipeline, at the re-fuel station. The off-loading conduit from the transport will be connected to the gas-entry conduits connected to valves at the openings to the bladders inside the steel storage vessels. By opening the valves on the delivery vehicle and the valves on the bladder, gas from the the delivery vehicle will flow to the storage vessel until pressures equalize. After pressure equalization, additional volumes of gas will be transferred into the bladders of the storage vessels by use of a hydraulic pump on the delivery vessel to collapse internal bladders inside the steel tubes on the transport vehicle, and squeeze the gas out into storage vessels. The inventor of the hydraulic method of un-loading gas from the delivery vehicle by the hydraulic pump method is also the inventor in this application. When the transport vessels have been emptied, as above, or the maximum storage gas has been delivered, the storage tanks will be disconnected from the transport vehicle which is then free to move to another location, or return to a pipeline for re-filling.

Once the three storage tanks have been re-filled from the transport vehicle, the hydraulic pump on the storage skid will be activated to pressurize a hydraulic fluid, in a closed system, from a surge tank to the individual storage vessels, through individual conduits, to control valves on flanges leading to the annular space between the steel vessel's outer walls and the outside of the flexible bladder inside the steel vessel. Continued operation of the hydraulic pump will increase the pressure of the gas in all three storage vessels as needed for a cascade delivery system. In order to effect the cascade delivery system, three distinct banks, i.e., the "high bank", the "medium bank", and the "low bank" with pressures inside the bladders of the three vesses of approximately 4000 psi, 3200 psi, and 2400 psi, respectively. When the operating pressures in each vessel have been obtained, the entry valves will be closed and the exit valves will be opened on demand from a sales dispenser. As the low-bank pressure decreases, and the on-board tank pressure increases, the flow rate to the sales vehicle decreases. At a pre-determined minimum flow rate, a logic controller will sequence the flow to the medium bank. Similarily, the sales vehicle will be filled from the medium bank until a pre-determined flow rate is reached, at which point the flow is sequenced to the high bank to complete the fill. As the bank pressures are decreased, a switch activated by the low or high bank, would open a control valve on the hydraulic fluid distribution conduit to permit pressurized hydraulic fluid to enter the annulus of the high bank storage vessel to raise the pressure of the gas in the bladder back to approximately 4000 psi to insure that the high bank is replenished first, then the medium bank raised back to approximately 3200 psi, and lastly, the low bank to approximately 2400 psi. Volumes of gas dispensed from each bank would be measured by conventional flow meters which will indicate; when it is time to re-fill the storage vessels.

It is the principal object of the present invention to provide a method and system for economically storing and transferring compressed natural gas (CNG) at an automotive re-fuel station, or other end-user site, without the use of multi-stage compressors. The key to obtaining this objective is to modify an approved storage vessel by inserting a flexible bladder, the same size as the internal walls of the storage vessel, which will maintain separation of the gas and a hydraulic fluid which is injected into the annulus to collapse the bladder and increase the pressure of the gas sufficient for it to flow to the sales conduits. The desired object will be obtained by utilizing a hydraulic pump system to pressurize a closed hydraulic system to pressures above the pressure of the gas inside the bladder. As the pressurized fluid is injected into the annulus between the bladder and the steel walls of the storage vessel, the pressure differential will compact the bladder, reducing the internal volume, with a resultant increase in pressure of the gas inside the bladder. The resultant increase in pressure will have been obtained without the use of a conventional gas compressor.

BRIEF DESCRIPTION OF THE DRAWINGS

Other objects and many attendant advantages of the present invention will become apparent from the following Description of the Preferred Embodiment, when taken in conjunction with the accompanying drawings.

FIG. 2-A is an enlarged, fragmentary diagrammatic view (top) of the storage vessel.

FIG. 3-B is an enlarged view (top) of storage vessel with pressure.

DETAILED DESCRIPTION OF THE PREFERRED EMBODIMENTS

Figure 1:
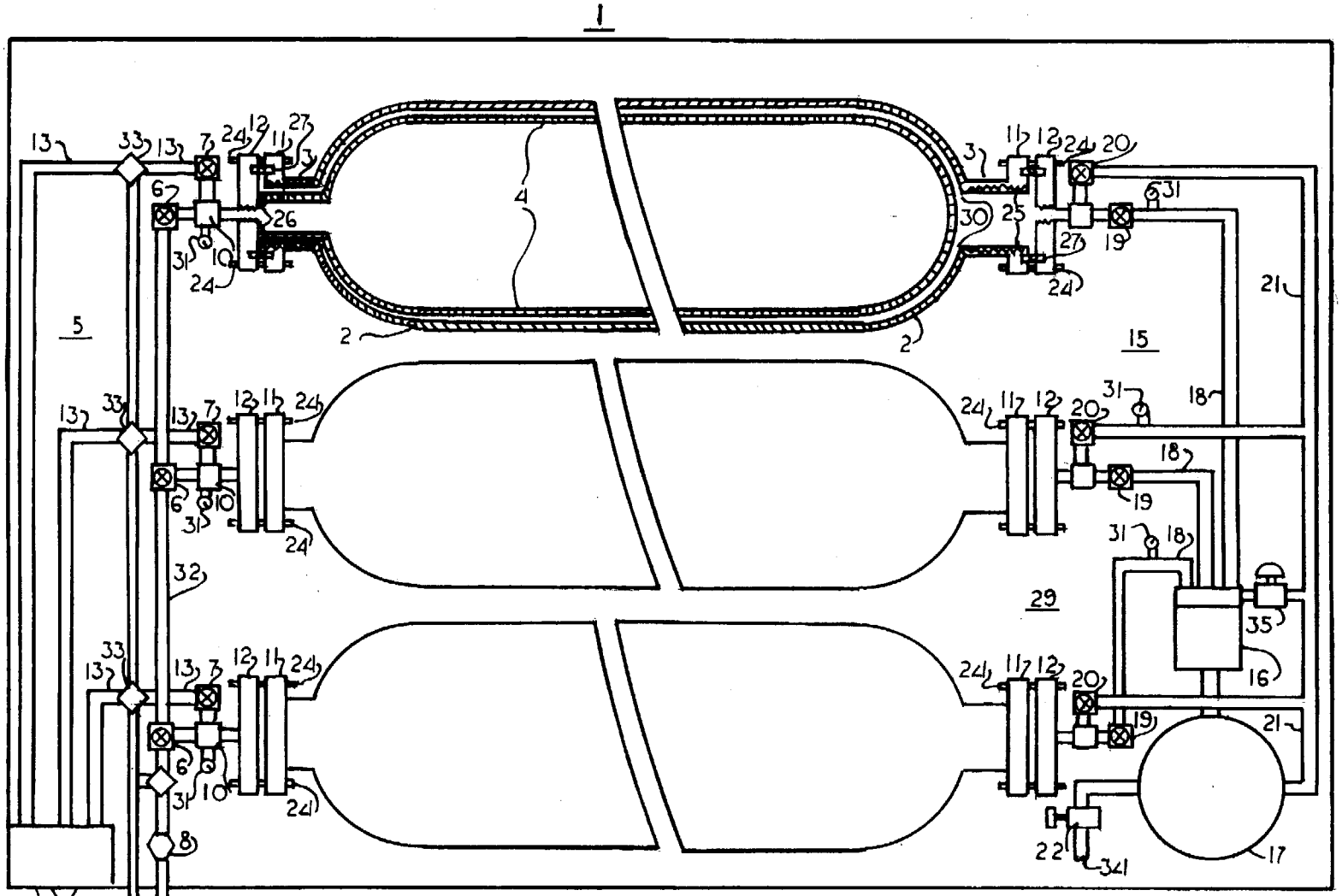
FIG. 1 is a diagrammatic view (top) of a skid-mounted re-fuel storage and pressurization unit.

In U.S. patent application Ser. No. 08/454,531, now U.S. Pat. No. 5,603,360, filed by the same inventor of this invention, there is disclosed a method and system for transporting natural gas, from a gas pipeline, to a compressed natural gas (CNG) re-fuel station, inside a flexible bladder, and to discharge the transported gas into storage at a CNG re-fuel station with the aid of a hydraulic pump instead of an expensive compressor.

It should be noted that the present invention utilizes the same bladder-squeeze technique for storage and transfer of stored gas to a dispenser to re-fuel automobiles, trucks, and busses, as that disclosed in patent application Ser. No. 08/454,531, now U.S. Pat. No. 5,603,360. While the prior patent application deals primarily with bladder-equipped high-pressure steel tubes approved by the Department of Transportation (DOT) for use in over-the-road transportation of natural gas, this present invention relates solely to the use of bladder-equipped high-pressure storage vessels, manufactured in accordance with ASME standards for storage of natural gas in municipal areas. Also included is a method and system of pressurizing the gas inside the bladders which are inside the steel vessesl, to levels sufficient to re-fuel on-board storage tanks in automobiles, trucks, and busses, all to be accomplished with a hydraulic fluid system instead of conventional gas compressors.

In the present distribution method, natural gas is received at a re-fuel station in a moveable transport vehicle, or from a nearby pipeline, where it is off-loaded for storage. The basic storage unit consists of three bladder-equipped ASME pressure vessels which will be operated, in a cascade arrangement of low-bank, medium-bank, and high-bank whereby CNG under various pressures will be made available to a re-fueling dispenser from the appropriate bank until the on-board storage tank on the re-fueling vehicle is completely full. Increasing the pressure of the gas inside the bladders, as gas is withdrawn for sales, will be accomplished by injection of a hydraulic fluid in the annulus between the bladder and the steel walls of the storage vessel, which will increase the pressure in the confined area and collapse the bladder, which will result in the same amount of gas being confined in a smaller container, resulting in an increased pressure of the gas.

The basic storage unit, three ASME storage vessels, together with the necessary gas filling and dispensing conduits, control valves, safety valves, together with the hydraulic pump, motor, surge tank, regulating valves, all mounted on a single skid, constitute a typical storage-pressurization unit for a typical CNG re-fueling station. If sales volumes dictate, additional modules of three storage vessels could be added.

The method and system are especially effective for storing and pressurizing natural gas at compressed natural gas (CNG) re-fueling stations. However, it is understood that the present method and system can also be utilized to satisfy other end-user needs such as furnishing CNG as fuel for gas-fired boilers, engines, turbines, and for emergency supplies of gas in the event of a supply interruption, or for use as temporary storage and pressurization of natural gas from isolated gas wells for transport to gas pipelines. In each instance, the loading and un-loading method and system will function in the same manner and the vessels can be evacuated by a hydraulic fluid system rather than an expensive compressor.

Given this explanation, it is understood that where storage and pressurization at a CNG re-fuel facility are referred to herein, it might instead refer to an end-user facility of some other function which has a need, short-term or permanent, for the same type storage and pressurization equipment.

The value of the invention for CNG re-fuel station storage and pressurization needs flows from several features thereof. First of all, by eliminating the need for compressors to evacuate natural gas from the pressure vessels, the savings from the initial costs and operating costs will enable compressed natural gas to be more competitive with gasoline and/or diesel as the preferred fluid for automobiles, trucks, and busses. Farther, the method and system of the invention provide for the safe and effective handling of the natural gas fuel, at re-fuel stations and other end-user facilities, utilizing relatively-untrained personnel who will be receiving, storing, pressurizing, and evacuating the storage vessels utilizing hydraulic fluid instead of high-pressure gas compressors.

Referring now to the drawings, FIG. 1 is a basic, three-vessel storage and pressurization unit, skid-mounted for installation in minimal surface areas generally available at CNG re-fuel stations, or other end-user sites. The skid-mounted unit, indicated at (1), contains three high-pressure cylinders (2) which are especially constructed to satisfy municipal codes for construction and operation of high-pressure vessels for storage of compressed natural gas in municipalities. These vessels (2) are seamless steel tubes, of ASME SA-372 material, Type IV, with sufficient wall thickness to contain working pressures up to 4000 psi with a safety factor of 3 (per ASME specifications for Boiler and Pressure Vessel Code, Section VIII, Division 1), with threaded out-lets on each end (3) with internal diameters of approximately ten inches to accomodate the insertion of a flexible bladder (4) inside each cylinder (2). The bladder (4) is a or, e-piece tube of elastomer material of conventional design with an external surface area essentially the same as the internal surface area of the steel cylinder (2) into which it is inserted so that when natural gas is injected into the bladder (4), the bladder (4) will extend and conform to the shape of the interior of the steel tube (2). As the pressure of the stored gas in the bladder (4) increases, the pressure will be contained by the steel tubes (2) backing-up the bladder (4)material.

On one end of the skid (1), generally at (5), is a natural gas loading and un-loading system consisting of conduits (32) and (13) respectively, entry control valves (6) and exit control valves (7) on each of the three storage vessels (2), a master control valve (8), one-half of a quick connect-disconnect coupling (9), conduits and couplings to connect the master valve (S) to the three entry valves (6), and couplings (10) to connect the entry valves (6) to the inner flange (11) which, together with the outer companion flange (12), provides entry access to the interior of the bladder (4) inside the steel storage vessels (2). Exit from the bladder (4) is accomplished by closing the entry valve (6) and opening the exit valve (7), which is connected by separate conduit (13) to a sequencing control apparatus whereby gas can be withdrawn from any one of the three storage vessels (2) to re-fueling dispensers or other end-uses.

On the opposite end of the skid (1), generally at (15), is a natural gas pressurizing apparatus consisting of a hydraulic pump and prime-mover (16), surge tank (17) and a manifold means whereby hydraulic fluid is pumped through conduits (18) to entry control valves (19) on each end of the storage vessels (2), individually or simultaneously, to pressure-up the annulus (30) between the outer walls of the bladder (4) and the inner walls of the storage vessels (2). Exit from the annulus (30) is accomplished by closing the entry valve (19) and opening the exit control valve (20) which is connected by separate conduits to a common-return maniflod (21) which is connected to the surge tank (17). Also shown is a control valve (22) which can be used to connect the surge tank (17) to an auxilary hydraulic fluid tank or drain line.

FIG. 2A is an enlarged view (top) of one of the three storage vessels of a typical natural gas storage unit. The upper view, generally at (23) is a cut-away view of a steel storage vessel (2), depicting the position of the flexible bladder (4) as it is inserted into the steel storage vessel (2) before the flanges (11) and (12) are bolted together with bolts (24). Entry into and exit from, the storage vessels (2) will be made through the threaded outlet (3), into which a threaded nipple (25) is attached which nipple (25) is attached to the inner flange (11). The bladder (4) is attached to the outer flange (12) by bonding to the face of the outer flange, shown generally at (26). The flanges, inner (11) and outer (12) are companion ring-gasket flanges, manufactured in accordance with API specifications for 4000 psi service. The ring-gasket (27) will effectuate the seal between the flanges when the flanges are bolted together. The open end of the bladder (4) will extend through the open ring-gasket (27) to the face of the outer flange (12) where it is bonded and sealed to effectuate the containment of natural gas inside the bladder (4).

The lower view on FIG. 2B, generally at (28) depicts the position of the flexible bladder (4), after the flanges on each end (11) and (12) have been bolted together with bolts (24), and after the bladder (4) has been expanded to it's maximum size, i.e., to the inner walls of the storage vessel (2), by the injection of natural gas through entry control valve (6) with exit valve (7) remaining closed. Also depicted, generally at (29) on the end of the storage vessel opposite the gas entry apparatus, a portion of the hydraulic fluid system is shown. The entry valves (19) and the exit valves (20) indicate where hydraulic fluid can be pumped into the annulus between the bladder (4) and the inner walls of the storage vessel (2) to collapse the flexible bladder (4) which results in an increase in the pressure of the gas inside the bladder. Upon depletion of the gas inside the bladder (4) to a sales dispenser (14), the annulus pressure can be released back to the surge tank (17) and the gas filling process described above can be repeated.

The present invention contemplates storing natural gas at several different pressure levels, and to have the capability to increase the pressure to levels desired to re-fuel automobiles, trucks, and busses in a cascade system, i.e., a portion of the refill is taken at one pressure level, additional gas taken at an intermediate level, and final fill taken from the top level. The method of the invention is to accomplish the storage and pressurization requirements without the use of expensive compressors, by creating a flexible storage vessel which can be evacuated using hydraulic fluid instead of gas compressors.

The manner in which the storage and pressurization system functions to carry out the method is believed to be evident from the above description thereof. In order to load, or re-supply, a typical three-vessel storage,; natural gas from a pipeline is transported to the re-fuel station, sometimes by extending the pipeline itself, but most often by hauling in over-the-road transport vessels. Upon arrival at the re-fuel station, the delivery vehicle is placed in position to off-load by connecting the transport vessel to the storage unit (1) on FIG. 1, by connecting to the mating half of the quick connect dis-connect coupling (9). The master control valve (8) is then opened and gas from the transport can flow to all storage tanks where the pressure is less than that available from the transport, by opening the appropriate entry valve (6). At such time as the storage tanks have accepted all of the supply gas that the delivery v vehicle can deliver, the entry valves (6) will be closed and the master valve (8) will be closed. After the pressure in the delivery line has been bled off, the quick connect-disconnect coupling can be separated and the re-supply operation has been completed.

Upon completion of the re-supply operation, the gas in storage inside the flexible bladders (4) at various pressures, can be delivered to the re-fuel dispensers from any of the three storage vessels as required. If the re-fuel station operator desires to re-fuel vehicles from a cascade system (a high-bank, a medium-bank, and a low-bank), the gas pressure in the three storage vessels can be changed utilizing the pressurization apparatus on the opposite end of the storage vessel, generally at (15), whereby the hydraulic pump (16) is activated to take hydraulic fluid suction from the surge tank (17); pressurize the fluid above the pressure of the gas inside the bladder (4) of the low-bank vessel and inject the hydraulic fluid, through control valve (19), into the annulus (30) between the bladder (4) and the steel walls (2). Increasing the pressure of the hydraulic fluid in the annulus (30) above the pressure inside the bladder (4) causes a partial collapse of the bladder (4) which will reduce the volume of the container in which the gas is stored, resulting in an increase in the pressure of the gas in the bladder (4). Injection is continued until the gas pressure in the low-bank vessel exceeds the pressure in the medium-bank and the high-bank, at which time the three vessels are in pressure equilibrium. Further increases inside the medium-bank, and the high-bank, can be achieved by repeating the same process in each vessel, or by pressurizing one vessel at a time and tranferring the higher pressure gas to another one of the banks.

Other equipment located on the pressurization end of the skid (1) include the pressure gauges (31) on each of the three discharge conduits (18) from the hydraulic pump leading to entry valves (19) on each of the three storage vessels, and exit valves (20) which can be opened, with entry valve (19) closed, to route the hydraulic fluid back to the surge tank (17) through conduits (21). Also included is a valve (22) and a conduit (34) for use with temporary low-pressure lines to drain the hydraulic fluid or re-fill the hydraulic system. Also included is a pressure regulating valve (35) which permits re-circulating part of the hydraulic fluid back to the surge tank to maintain pressure, and to serve as a safety relief valve.

Other equipment located on the gas-entry end of the skid (1), generally at (5), are the pressure gauges at the outlet-inlet of each storage vesse (31) which registers the pressure of the gas inside the bladder (4) at all times. Also included are individual exit valves (7) and individual conduits (18) from each storage vessel (2) to the dispensing unit. Also shown are the master valve (8) and the entry conduit (32), and the mating-half of a quick connect-disconnect coupling. The dispensing unit is a priority panel which directs, or priortizes, storage vessel deliveries to re-fuel vehicles. Priority panels, of conventional design, may vary as to mechanisms and functions but will serve to dispense to vehicles a measured amount of gas from the low-bank switch over, when instructed to do so from a logic sequencer, to the medium-bank, and top-off from the high-bank. Also indicated are safety valves (33) which are pre-set maximum pressure devices on each conduit (13) to the three storage vessels (a) which will prevent excessive pressure on the dispenser.

It is believed apparent from the above how the present method and system of storing and pressurizing natural gas can be adapted for uses other than compressed natural gas (CNG) re-fuel stations. The method of the invention remains the same, i.e., the use of a flexible bladder inside a steel storage tank whereby gas inside the bladder may be increased in pressure by pumping hydraulic fluid in the annulus between the bladder and the steel walls, thereby collapsing the bladder and confining the gas in a smaller volume which increases the pressure. Other end-uses would be to store gas for fuel in areas removed from natural gas pipelines for industrial or municipal users provide gas for stand-by service in situations where curtailments of gas supply cannot be tolerated; provide gas for areas where transportation is restricted because of terrain or bodies of water; and many other uses where pressurization by a conventional gas compressor would be excessively expensive, such as on-board cylinders on fork-lift, airport baggage and passenger transports, and other such uses.

The present method and system fulfills all of the objects set forth hereinabove for the invention, and make it the best possible way to economically store and pressurize natural gas at automotive re-fuel stations other uses. Thus the availability of natural gas, the environmentally-preferred fuel for automobiles, busses, and trucks, can be such that it can economically compete with gasoline and diesel for automotive fuel use. In addition, the increased use of natural gas as the primary fuel for automobiles, trucks, and busses will open further opportunities to reduce the amount of crude oil used to make gasoline, which, in turn will reduce the reliance on foreign crude oil as the primary source of domestic energy requirements. The reduced reliance on foreign oil imports could have a major favorable impact upon the United States Adverse balance-of-payments and a major beneficial effect on the U.S. budget and long-term debt.

It should be noted that the present invention utilizes the concept of a system for transporting natural gas from a pipeline to a compressed natural gas automotive re-fuel station, as proposed by the same inventor in patent application Ser. No. 08/454,531, now U.S. Pat. No. 5,603,360 to contain natural gas inside a flexible bladder during transportation, or, in this invention, to store and pressurize natural gas utilizing a hydraulic pump system instead of a more-expensive gas compressor system. It is the pressurization method of this invention which makes the technique for storage of natural gas both effective and economically sound.

Obviously, many modifications and variations of the invention are possible. Further, it is evident that the method and system as described herein meets the objects set forth hereinabove, and that the invention makes possible the storage and dispensing of natural gas at CNG re-fuel stations, and other end-uses.

The invention claimed is:

1. A system for storing and pressurizing natural gas for use at a compressed natural gas (CNG) re-fuel station, or other end-user location, comprising:

a pressure-containment means having a plurality of seamless steel pressure vessels, and a flexible bladder means disposed within each of said plurality of seamless steel pressure vessels whereby natural gas is off-loaded into the bladder means from a moveable supply or pipeline, and a conduit means to disburse natural gas from the said seamless steel pressure vessels which is fluidically-connected to a sequencing control apparatus which is adapted to be connected to a sales dispenser, and a hydraulic-fluid pressure-assistance means whereby a hydraulic pump is fluidically-connected to the annulus formed between the inner walls of the said seamless steel pressure vessels and the outer walls of the flexible bladder means whereby the pressure of the natural gas inside the bladder means is increased by pumping a hydraulic fluid into the annulus which collapses the flexible bladder means and squeezes the gas to a higher pressure or out of the bladder means to said sequencing control apparatus, wherein said sequencing control apparatus is arranged to selectively supply gas from one or a plurality of said seamless steel pressure vessels.

2. A system according to claim 1 wherein said flexible bladder means further comprises:

a flexible bladder constructed of chemical compositions in the elastomer family of synthetic rubber products which has the required characteristic of zero permeability to natural gas and will not react, chemically, with natural gas, and a bladder-attachment means whereby the bladder opening is bonded to the face of a conventional API ring-gasket flange which provides separation of the gas inside the bladder from the hydraulic fluid in the annulus, and also provides the means whereby the flange can be un-bolted from the companion-flange connected to the storage vessel which enables the bladder to be removed for inspection or repairs, and, a flange connection means for gas entry into, and exit from, the bladder inside said seamless steel pressure vessel, and an identical flange connection means for hydraulic fluid entry into and exit from the annular space between the bladder and the steel walls of the pressure vessels.

3. A system, according to claim 1, wherein each seamless steel pressure vessel means further comprises:

a steel cylindrical tube, manufactured in accordance with ASME Boiler and Pressure Vessel Code, Section VIII, Division 1 specifications for storage of natural gas in municipal areas, to withstand pressures up to 4000 psig, and a threaded outlet on each end of the said steel cylindrical tubes to which flanges are connected, and a threaded nipple to connect the said threaded outlet on each steel cylindrical tube through which the said bladder means can be inserted into the said steel cylindrical tube, and through which the bladder means can be withdrawn, and a flange connection means on each end of the said steel cylindrical tube which accommodates the connection to companion flanges of the same size, materials, and strength to serve two purposes as follows:

the companion flange on one end of the pressure vessel is bolted to the flange on the threaded nipple connected to the threaded outlet of the pressure vessel, and is connected to a threaded outlet valve connection attached to the conduit means, and the companion flange on the opposite end of the pressure vessel is bolted to the other flange on the threaded outlet on the opposite face of the flange to accommodate a threaded valve connection from the hydraulic pump to the steel cylindrical pressure vessel.

* * * * *

UNITED STATES PATENT AND TRADEMARK OFFICE

CERTIFICATE OF CORRECTION

PATENT NO. : 5,676,180
DATED : October 14, 1997
INVENTOR(S) : James R. Teel

It is certified that error appears in the above-identified patent and that said Letters Patent is hereby corrected as shown below:

Column 3, line 49, "FIG. 3-B" should read --FIG. 2-B--.

Signed and Sealed this

Twenty-third Day of December, 1997

*Attest:*

Bruce Lehman

BRUCE LEHMAN

*Attesting Officer*

*Commissioner of Patents and Trademarks*